US006599136B2

(12) United States Patent
Sheldon et al.

(10) Patent No.: US 6,599,136 B2
(45) **Date of Patent: *Jul. 29, 2003**

(54) SOCKET APPARATUS FOR A PLUG-IN MODULE

(75) Inventors: Steven D. Sheldon, Auburn, CA (US); David R. Cowles, Granite Bay, CA (US); Melissa S. Gedraitas, Vancouver, WA (US)

(73) Assignee: Hewlett-Packard Development Company, L.P., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/760,983

(22) Filed: Jan. 16, 2001

(65) Prior Publication Data

US 2002/0094709 A1 Jul. 18, 2002

(51) Int. Cl.[7] ..... H01R 4/66
(52) U.S. Cl. ..... 439/92; 439/609
(58) Field of Search ..... 439/79, 92, 607, 439/609

(56) References Cited

U.S. PATENT DOCUMENTS

| | | | | |
|---|---|---|---|---|
| 4,878,858 A | * | 11/1989 | Dechelette | 439/607 |
| 6,053,773 A | * | 4/2000 | Wu | 439/609 |
| 6,067,234 A | | 5/2000 | Kim et al. | |
| 6,135,790 A | * | 10/2000 | Huang et al. | 439/79 |
| 6,186,830 B1 | * | 2/2001 | Lin et al. | 439/607 |

FOREIGN PATENT DOCUMENTS

| | | |
|---|---|---|
| EP | 1026785 | 9/2000 |

* cited by examiner

*Primary Examiner*—Tho D. Ta
*Assistant Examiner*—Ann McCamey

(57) ABSTRACT

A socket apparatus for receiving and supporting a plug-in module in a host device such as a peripheral device. The socket apparatus is mounted and fully supported by a printed circuit board and requires no additional support from the host device chassis or by a cosmetic case or housing. The apparatus is elevated relative to the printed circuit board so that valuable real estate on the board is not appreciably diminished by the apparatus. The apparatus provides an effective low impedance REI ground path, provides support to the host electrical connector and minimizes a number of parts and tolerance stack-up.

17 Claims, 4 Drawing Sheets

SOCKET APPARATUS FOR A PLUG-IN MODULE

The present invention relates to apparatus for supporting modular electronic subsystems on electrical and electronic devices, and more particularly to a socket apparatus for receiving and supporting modular devices that are inserted into a host device, such as a printer or other peripheral device.

It has been a common practice in the manufacture of electronic components to provide additional functional capability in the form of modular electronic subsystems that can be easily coupled to larger electronic devices. One common example involved the use of font cartridges on laser and other printers in home and office environments. Such font cartridges were merely plugged into the printer and provided additional fonts for the user. Other examples included transceiver slots on network switches and in internal print servers and modules for multi-function peripheral devices, which could scan, fax, print and copy. The use of modular subsystems or components to vary the functionality of such peripheral devices was a convenient, flexible and inexpensive alternative to the replacement of such devices or the need to manufacture many different models of such devices to satisfy differing functional needs.

The disadvantages of such previous solutions included the necessity of using additional parts to provide mechanical support and retention of the auxiliary module. They also required the maintenance of tight tolerances between the host electrical connection and the module support. Some of the solutions also lacked a low impedance ground path, which can be important for reliability of operation. Moreover, some solutions utilized plastic resin which affected the amount of space required to provide sufficient mechanical strength.

SUMMARY OF THE INVENTION

The present invention relates to a socket apparatus for supporting modular devices that are inserted into the host device. The apparatus is a robust, low cost solution for supporting a module that is insertable into a host device and providing a low impedance RFI ground path for the module. The apparatus also supports and protects the host electrical connector, minimizes the number of host parts and tolerance back up and provides design flexibility to suppliers who provide modules for use in a host device.

The present invention is preferably mounted on a printed circuit board having a connector mounted thereto adapted to receive a connector in the module that is inserted into the socket apparatus. The socket apparatus has a support structure including a plurality of legs adapted to be inserted into apertures in the printed circuit board and be soldered in place. The bulk of the socket apparatus is elevated above the printed circuit board so that important real estate between the socket structure and the printed circuit board surface can be used for placement of circuit components in the printed circuit board. The support structure is designed such that it permits great flexibility in terms of the mounting and location of the apparatus on a printed circuit board which may have many diverse configurations for use in different types of electronic devices.

DETAILED DESCRIPTION

Broadly stated, the present invention is directed to a socket apparatus that is adapted to receive an electronic module with the socket apparatus being installed in a host device, such as a peripheral electronic device. The socket apparatus embodying the present invention is preferably mounted to a printed circuit board having a plurality of components mounted thereon, including a connector which is adapted to receive a mating connector in the module that is to be inserted into the socket apparatus. In addition to providing support for the module and facilitating the coupling of the connectors, the socket apparatus is designed to provide a low impedance radio frequency ground path to minimize electrical interference that may detrimentally affect the operation of the host device and/or module combination. It is therefore preferable that the socket apparatus be made of conductive metal which may be relatively thin but strong and provide adequate physical support for the plug-in module.

The socket structure is designed to be mounted to the printed circuit board and provide a low impedance ground path from the structure to the printed circuit board. The unique design provides support and protection for the host electrical connector and promotes design efficiency and maximizes use of the real estate of a printed circuit board. This is because the bulk of the socket apparatus is elevated above the printed circuit board so that circuit components can be mounted in the space between the socket apparatus and the surface of the printed circuit board. The mounting of the socket apparatus to the printed circuit board enables the designer to easily design the opening in the housing or case of the host peripheral so that the module can be easily plugged in by a user. Because the socket apparatus guides the module into position so that the connectors are aligned for coupling, the tolerances of the position of the socket apparatus relative to the peripheral chassis and the outer case of the host peripheral need not be particularly tight.

Figure 1:
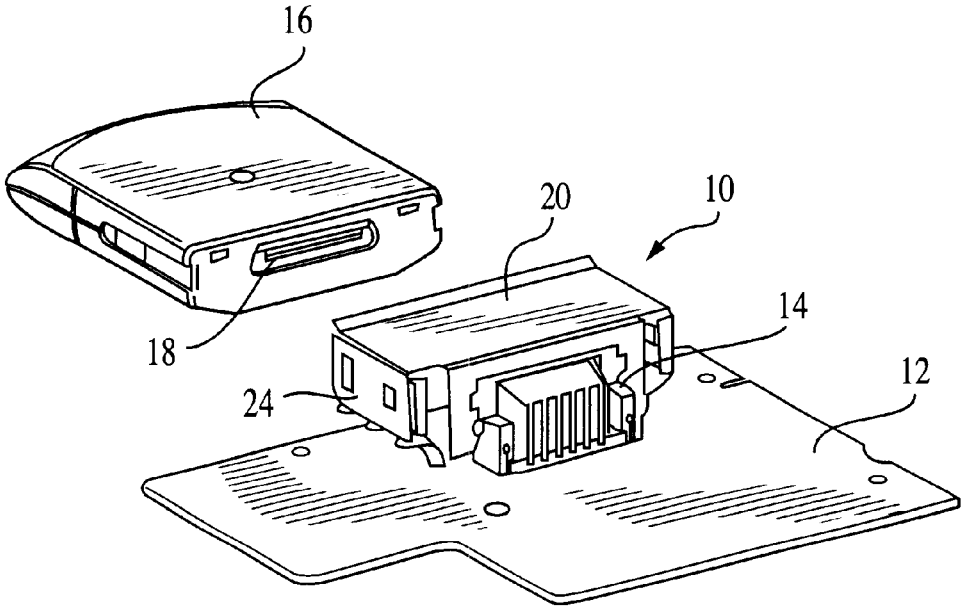
FIG. 1 is an isometric view of the rear of the socket apparatus of the present invention with portions removed, but shown mounted to a printed circuit board together with a right angle multi-pin connector and also illustrating a module adapted for insertion into the socket apparatus.
Figure 2:
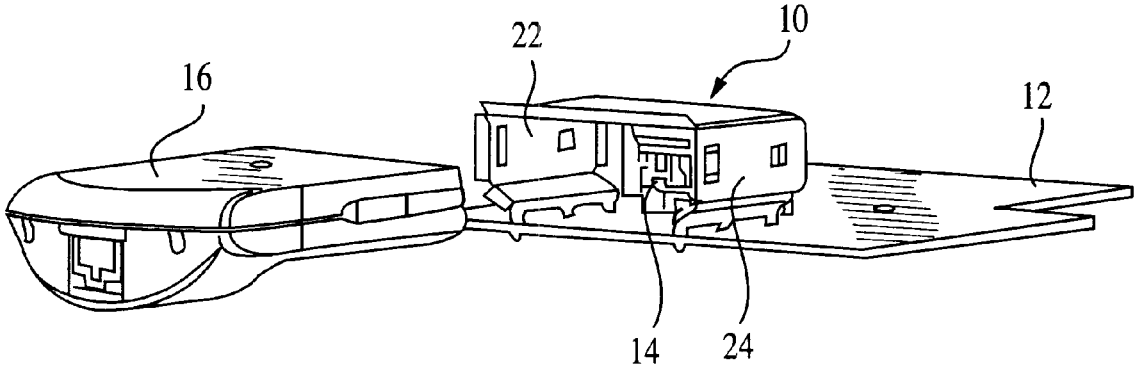
FIG. 2 is a isometric view of a front portion of the socket apparatus shown in FIG. 1 mounted to the printed circuit board and also illustrating the insertable module.

Turning now to the drawings and particularly FIGS. 1 and 2, the socket apparatus embodying the present invention is indicated generally at 10 and is shown mounted to a printed circuit board 12 that is not in and of itself a part of the present invention. The printed circuit board also has a multi-pin connector 14 attached thereto, and it is a right angle connector which is accessible from the interior of the socket apparatus 10. A module 16 is shown and it has a connector 18 that is adapted to mate with the connector 14 when the module 16 is inserted into the socket apparatus 10.

Figure 3:
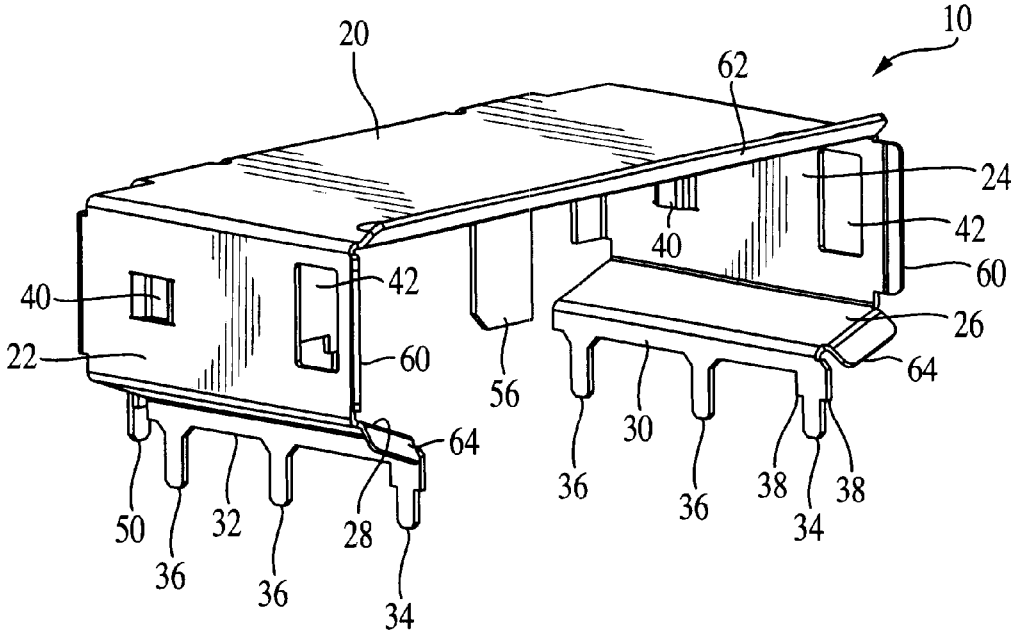
FIG. 3 is an isometric view of the front and left side of socket apparatus embodying the present invention.
Figure 4:
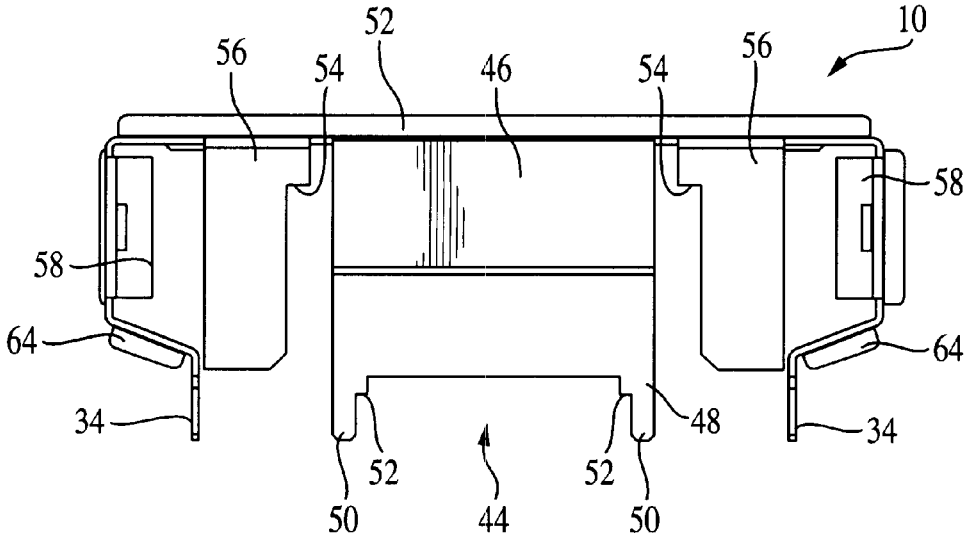
FIG. 4 is a front view of the apparatus shown in FIG. 3.
Figure 5:
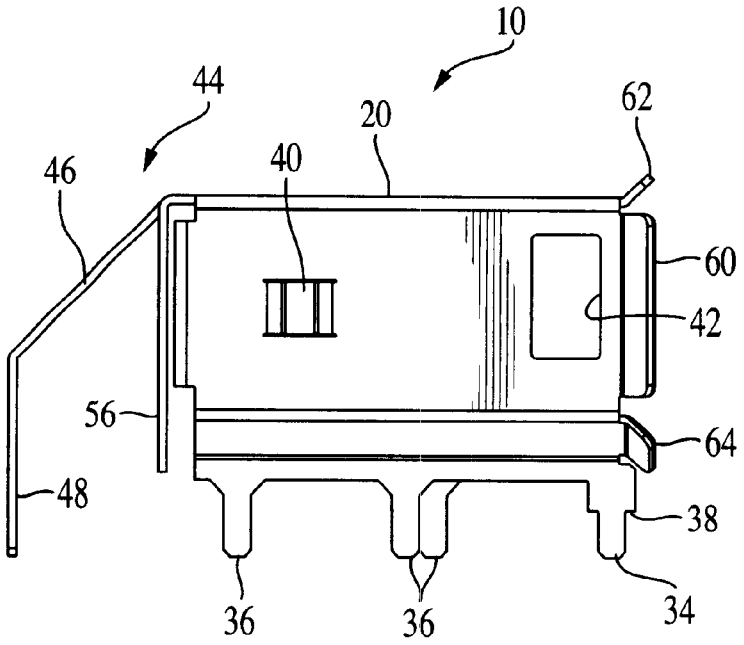
FIG. 5 is a left side view of the apparatus shown in FIG. 3.
Figure 6:
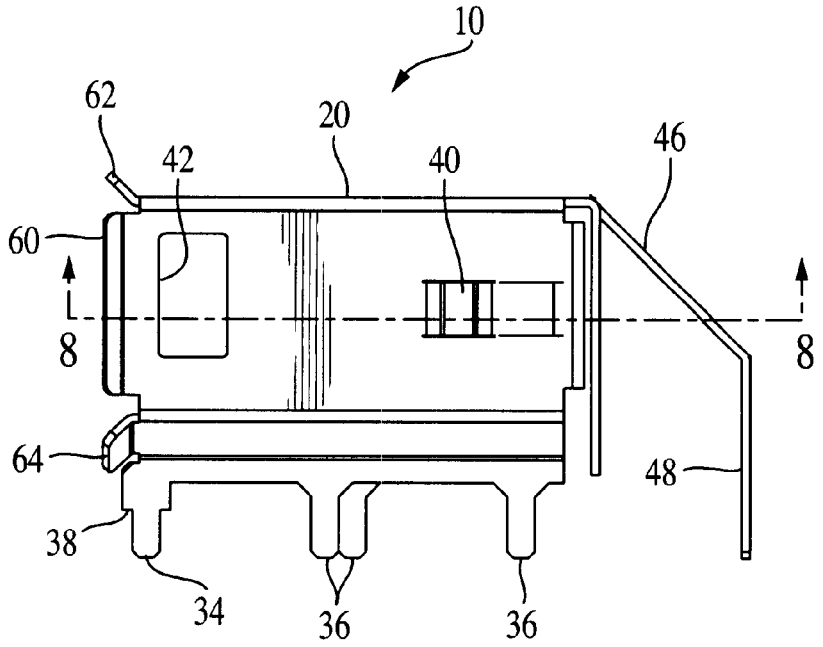
FIG. 6 is a right side view of the apparatus shown in FIG. 3.
Figure 7:
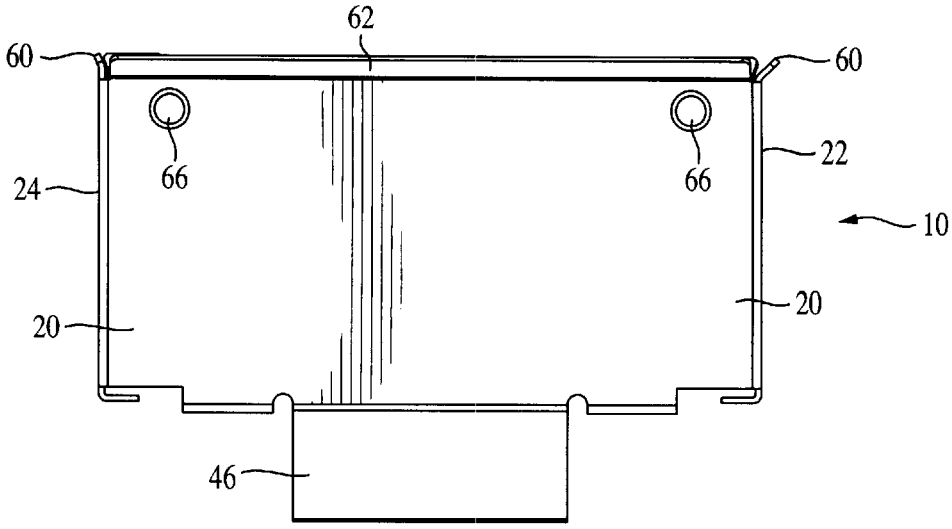
FIG. 7 is a top view of the apparatus shown in FIG. 3.
Figure 8:
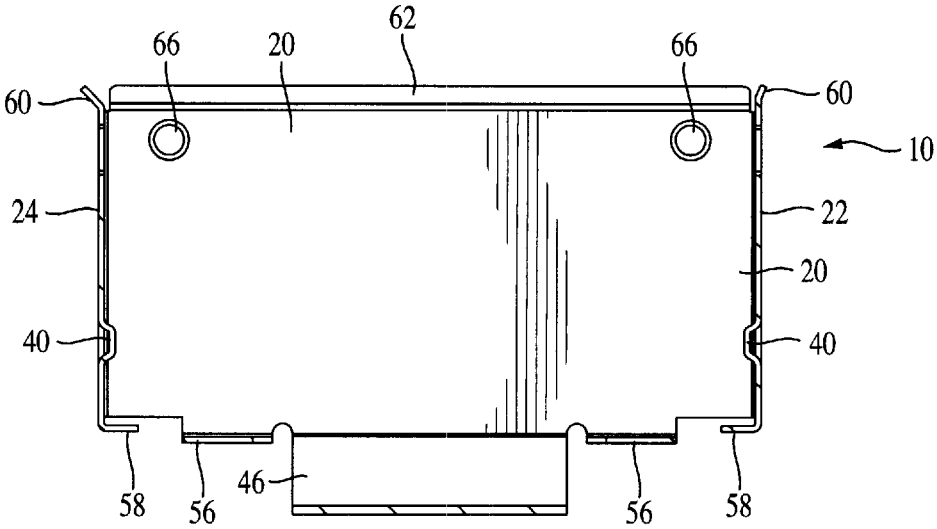
FIG. 8 is a cross-section taken generally along the line 8—8 in FIG. 6.
Figure 9:
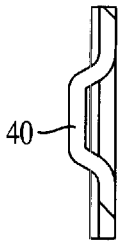
FIG. 9 is an enlarged detail of a portion of the apparatus shown in FIG. 8.

Referring to the enlarged isometric view of the socket apparatus 10 shown in FIG. 3, it has an opening in the front portion through which the module 16 can be inserted, and has a flat top wall 20, a left side wall 22, a right side wall 24, a right bottom fold 26 and a left bottom fold 28. The description of the apparatus referred to in the drawings, including FIG. 3 shows a particular illustrated orientation, wherein the wall 20, for example, is referred to as the top wall. It is this orientation that provides the disclosure and support for the claims, and it should be understood that the structure of the invention may be installed in a horizontal as well as a vertical orientation or position. A support structure is attached to the bottom folds 26 and 28 and is in the form of vertical folds 30 and 32, each of which have legs 34 and 36 extending therefrom. The legs 34 have a wider top portion which creates a ledge 38 on opposite sides of the leg 34. The ledges 38 are intended to limit the insertion depth of the legs 34 as they are inserted into suitably sized apertures in the printed circuit board. The legs 34 are on the opening end portion of the socket apparatus and the position of the ledges 38 on the front of the apparatus control the elevation of the front portion of the apparatus relative to the printed circuit board.

In accordance with an aspect of the present invention, the bottom folds 26 and 28 contact the lower portion of the module 16 when it is inserted and these surfaces support the module in its elevated position relative to the printed circuit board 12. It should be appreciated that the angle of the folds 26 and 28 are intended to conform to the shape of the module 16, and may therefore vary in degree depending upon the shape of the module 16. In fact, the height of the side walls 22 and 24 may similarly be varied for similar reasons.

As previously mentioned, the depth of insertion of the legs 34 and 36 control the elevation of the socket apparatus above the printed circuit board. An important aspect of the present invention is that real estate on the printed circuit board is not significantly reduced by the presence of the socket apparatus for the reason that it is elevated above the surface of the printed circuit board so that electronic components can be mounted thereto between the apparatus and the printed circuit board. The socket apparatus is preferably manufactured from an electrically conductive material such as 6 millimeter thick cold rolled steel which is also electrically conductive and is adapted to provide a low impedance ground path from the socket apparatus 10 to the printed circuit board. In this regard, the legs 34 and 36 are preferably soldered into the printed circuit board to provide a structurally strong apparatus. It should also be appreciated that the use of relatively thin sheet metal provides greater structural support and requires less space than plastic sockets having wall thicknesses in the range of 2–3 millimeters.

It is also preferred that the apparatus embodying the present invention be made from a unitary piece of sheet metal that is stamped, bent and otherwise processed appropriately, but it is within the scope of the present invention to have multiple pieces of sheet metal or other material that are fabricated together in an appropriate manner well known to those of ordinary skill in the art.

With regard to the low impedance RFI ground path that is provided by the apparatus embodying the present invention, the side walls 22 and 24 have a lance 40 that extends inwardly a slight distance as shown in FIGS. 3, 5, 6, 8 and 9. To form the lance, the material is sheared on the top and bottom thereof and then the material between the shear lines is pressed inwardly to form the extension illustrated. The lance 40 provides a ground contact with the module 16. In this regard, a ground contact is preferably designed into the side portions of the module 16 (not shown), so that when the module is fully inserted, the ground contacts of the module will be in contact with the lances 40 and provide a good ground connection for the module 16 to be ground on the printed circuit board. The side walls 22 and 24 also have cut-outs 42 for cooperating with a latching mechanism (not shown) that is preferably provided on the module 16.

In accordance with an important aspect of the present invention and referring to the back or connector portion thereof, the socket apparatus has an end wall 44 that is connected to the top wall 20, with the end wall 44 having an approximately 45° fold portion 46 and a second vertical end fold portion 48. The end wall 44 extends over the connector 14 and at least partially electrically and mechanically shields the same. Also, the end wall has legs 50 on opposite ends thereof, with the legs 50 terminating in a ledge 52 (similar to the ledge 38 of leg 34) that is positioned to limit the depth of insertion of the legs 50 into the printed circuit board.

However, the actual depth of insertion is preferably not controlled by ledges 52 but by ledges 54 in a pair of spaced apart symmetrical rear folds 56 attached to the top wall 20. The ledges 54 are adapted to contact the top surface of the connector 14 and accurately position the socket apparatus relative to the connector as is desired.

A pair of side folds 58 are provided on each of the sides 22 and 24 for the purpose of increasing the strength of the structure and to provide a stop against over-insertion of the module 16 into the socket apparatus 10. It is also preferred that the sidewalls 22 and 24 have outwardly flared flaps 60 at the front thereof to guide insertion of the module into the socket apparatus. Similarly, the top wall 20 has an angled top flap 62 for providing a lead-in for the module 16 and the right and left bottom folds 26 and 28 have an angled flap 64 for the same purpose. It should also be appreciated that the folds 60, 62 and 64 not only provide a guide or lead-in for the module 16, but also increase the structural integrity of the portions from which they are bent.

It is also preferred that the top surface 20 have a pair of inwardly protruding dimples or embossed areas 66 which are provided to reduce the amount of movement or play that may exist for the module 16 when it is inserted.

From the foregoing, it should be understood that the robust effective solution for supporting a plug-in module in a host device such as a peripheral has been shown and described which has many advantages and desirable attributes. The socket apparatus embodying the present invention provides an effective low impedance RFI ground path, provides support to the host electrical connector and minimizes a number of parts and tolerance stack-up compared to other prior solutions. The apparatus is elevated relative to the printed circuit board so that valuable real estate on the board is not appreciably diminished by the apparatus. Moreover, the fact that the socket apparatus is mounted and fully supported by a printed circuit board requires no additional support from the host device chassis or by a cosmetic case or housing. This obviates the need for additional parts and thereby reduces the cost and minimizes issues of tolerance stack-up between mating parts on the host device. Additionally, by keeping the module support independent from the host device chassis and case, fewer design constraints are placed on the host thereby allowing the socket apparatus to be more easily incorporated into a wide variety of host devices. The socket apparatus provides for accepting module latches that provide positive retention of the module 16 in the socket apparatus 10.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. Apparatus for receiving a plug-in electronic module in a host device having at least one printed circuit board and a multi-conductor first connector operably connected to the printed circuit board, the module having a second connector for coupling said module with said first connector, said apparatus having a connector end portion and a receiving end portion opposite said connector end portion, said apparatus comprising:

a center portion configured to receive at least a portion of the module and to physically support the module when it is plugged-in, said center portion having a top wall, two side walls and a bottom extending from the connector end portion to the receiving end portion, said bottom comprising a pair of opposing folds extending from each of said side walls inwardly toward the other;

a support structure extending from each of said pair of opposing folds for attachment to the printed circuit board whereby the bottom is spaced from the printed circuit board surface such that electronic components can be located therebetween, the support structure providing a ground connection for said apparatus to the printed circuit board.

2. Apparatus as defined in claim 1 wherein at least one of said side walls includes an inwardly protruding lance for contacting a ground connecting surface of the module when the module is inserted therein.

3. Apparatus as defined in claim 1 wherein each of said top wall, side walls and bottom have a flared flap extending at an angle away from the inside of the apparatus at the receiving end portion thereof, said flared flaps defining a lead-in for insertion of the module into the apparatus.

4. Apparatus as defined in claim 1 wherein said apparatus is fabricated from a unitary piece of thin metal.

5. Apparatus as defined in claim 1 wherein each of said side walls have a vertical flap extending therefrom at an approximate 90 degree angle at the connector end portion, said flap providing added structural strength to the apparatus.

6. Apparatus as defined in claim 1 wherein said top wall has at least one inwardly protruding embossed area adjacent the receiving end portion for limiting the amount of vertical movement by the module that is permitted near the receiving end portion.

7. Apparatus as defined in claim 1 wherein said support structure comprises a plurality of legs extending from said pair of opposing folds downwardly for insertion into apertures of predetermined size within the printed circuit board.

8. Apparatus as defined in claim 7 wherein said plurality of legs comprises at least one leg on each pair of opposing folds wherein the outer end of each of said at least one leg has a reduced cross-sectional area and forming a ledge at the intersection of said at least one leg and its reduced cross-sectional area that is larger than the aperture of the printed circuit board which receives the at least one leg thereby limiting the depth of insertion of the plurality of legs, said ledge being disposed below said pair of opposing folds.

9. Apparatus as defined in claim 7 wherein each of said pair of opposing folds extends inwardly an amount whereby said legs are positioned near said side wall from which said bottom portion extends.

10. Apparatus as defined in claim 9 wherein each of said pair of opposing folds are downwardly sloped toward one another.

11. Apparatus as defined in claim 1 further comprising an end wall extending from said top wall at the connector end portion thereof, said end wall being of two sections, including an angled section merging into a vertical section, said end wall electrically and mechanically shielding the first connector.

12. Apparatus as defined in claim 11 wherein the vertical section of said end wall includes a downwardly extending leg at opposite ends thereof, the outer ends of the legs having a smaller cross-sectional area to thereby define a ledge for limiting the depth of insertion thereof into apertures in the printed circuit board.

13. A socket apparatus for receiving a plug-in electronic module in a host device having at least one printed circuit board and a multi-conductor first connector operably connected to the printed circuit board, the module having a second connector for electrically and mechanically interconnecting said module with said first connector, said socket apparatus comprising:

an elongated structure having a hollow interior with an opening at a first end through which the module can be inserted to interconnect said first and second connectors and to physically support the module when it is plugged-in, said elongated structure being configured to at least partially surround at least a portion of the first connector when said portion is in position to interconnect with the second connector when the module is plugged-in;

said structure having a top wall, two sidewalls, a bottom portion and a rear end portion;

a mounting substructure extending from said structure for attachment to the printed circuit board, said substructure including first and second sets of downwardly extending legs whereby the bottom is spaced from the printed circuit board surface such that electronic components can be mounted between the bottom of the structure and the printed circuit board, the mounting substructure providing a ground connection from said elongated structure to the printed circuit boards;

wherein said rear end portion extends from said top wall, said end wall being of two sections, including an obliquely angled section merging into a vertical section, said end wall electrically and mechanically shielding the first connector.

14. Apparatus as defined in claim 13 wherein said mounting substructure comprises a plurality of legs extending from said bottom downwardly for insertion into apertures of predetermined size within the printed circuit board.

15. A method of providing support for a cartridge on a host device, the host device having at least one printed circuit board and a multi-conductor first connector operably connected to the printed circuit board, the cartridge having a second connector for electrically and mechanically interconnecting said cartridge with said first connector, comprising:

mounting a socket to the circuit board, the socket comprising an elongated structure having a hollow interior with an opening at a first end through which said cartridge is inserted to interconnect said first and second connectors, wherein said cartridge is physically supported by said hollow interior, said elongated structure being configured to at least partially surround at least a portion of the first connector to interconnect with the second connector of said cartridge, said elongated structure having a top wall, two sidewalls, a bottom portion and a rear end portion;

wherein the socket is attached to the printed circuit board via a support structure to create a clearance between the bottom of said elongated structure and the printed circuit board surface such that electronic components can be mounted between the bottom of the elongated structure and the printed circuit board.

16. The method of claim 15 wherein said support structure includes at least one set of legs wherein the outer end of each of said set of legs has a reduced cross-sectional area and forming a ledge at the intersection of said at least one leg and its reduced cross-sectional area that is larger than a mating aperture of the printed circuit board which receives the at least one leg thereby limiting the depth of insertion of the plurality of legs, said ledges being disposed below the bottom of the socket, and wherein said step of mounting includes inserting each of said set of legs into the mating apertures so that each of said ledges contacts the circuit board and limits the depth of insertion.

17. Apparatus for receiving a plug-in electronic module in a host device having at least one printed circuit board and a multi-conductor first connector operably connected to the printed circuit board, the module having a second connector for coupling said module with said first connector, said apparatus having a connector end portion and a receiving end portion opposite said connector end portion, said apparatus comprising:

a center portion having a top wall, two side walls and a bottom extending from the connector end portion to the receiving end portion;

a support structure for attachment to the printed circuit board whereby the bottom is spaced from the printed circuit board surface such that electronic components can be located therebetween, the support structure providing a ground connection for said apparatus to the printed circuit board;

an end wall extending from said top wall at the connector end portion thereof, said end wall being of two sections, including an angled section merging into a vertical section, said end wall electrically and mechanically shielding the first connector, wherein the vertical section of said end wall includes a downwardly extending leg at opposite ends thereof, the outer ends of the legs having a smaller cross-sectional area to thereby define a ledge for limiting the depth of insertion thereof into apertures in the printed circuit board;

said apparatus further including a pair of spaced apart vertical end folds that extend downwardly from the top wall thereof at the connector end portion, said vertical end folds having a vertical recess in the inside portions thereof extending from the lower end upwardly and defining a ledge near the top wall thereof, the distance between the inside edges of said recesses being slightly larger than the width of the said first connector, said ledges being adapted to contact the top of said first connector and limit the depth of insertion of said legs of said end wall.

* * * * *

UNITED STATES PATENT AND TRADEMARK OFFICE

CERTIFICATE OF CORRECTION

PATENT NO. : 6,599,136 B2
DATED : July 29, 2003
INVENTOR(S) : Steven D. Sheldon et al.

It is certified that error appears in the above-identified patent and that said Letters Patent is hereby corrected as shown below:

Title page,
Item [75], Inventors, delete "Gedraitas" and insert therefor -- Gedraitis --

Signed and Sealed this

Fifth Day of April, 2005

JON W. DUDAS
*Director of the United States Patent and Trademark Office*